United States Patent [19]

Fruth

[11] Patent Number: 4,971,169

[45] Date of Patent: Nov. 20, 1990

[54] METHOD AND APPARATUS FOR SCAFFOLDING

[76] Inventor: Duane V. Fruth, 7352 Ahles Rd., St. Cloud, Minn. 56301

[21] Appl. No.: 450,161

[22] Filed: Dec. 12, 1989

[51] Int. Cl.[5] ..... E04G 3/08; E04G 3/10

[52] U.S. Cl. ..... 182/119; 182/150; 182/152

[58] Field of Search ..... 182/118, 119, 150, 151, 182/152

[56] References Cited

U.S. PATENT DOCUMENTS

| | | | |
|---|---|---|---|
| 197,766 | 12/1877 | Crawford | 182/119 |
| 2,308,142 | 1/1943 | Alloway | 182/150 |
| 3,124,213 | 3/1964 | Jorsey | 182/150 |
| 3,134,567 | 5/1964 | Shoemaker | 182/150 |
| 3,391,757 | 7/1968 | Duke | 182/150 |
| 4,029,173 | 6/1977 | Wakabayashi | 182/150 |
| 4,074,792 | 2/1978 | Zaugg | 182/150 |
| 4,089,389 | 5/1978 | Olssom | 182/119 |
| 4,263,985 | 4/1981 | Shady | 182/119 |

FOREIGN PATENT DOCUMENTS

| | | | |
|---|---|---|---|
| 395503 | 12/1965 | Switzerland | 182/150 |

*Primary Examiner*—Reinaldo P. Machado
*Attorney, Agent, or Firm*—Henry C. Kovar

[57] ABSTRACT

An improved method and apparatus of scaffolding during building has a scaffold with folding hanger and work frames, storable bumpers on the work frame for propping the scaffold off of a wall, and a hanger structure in the hanger frame for suspending the scaffold from the cap or upper header of a building wall. The scaffold is also usable as a sawhorse and a ground/floor supported scaffold. The method of scaffolding provides the steps of hanging the scaffold from the header or cap, propping the scaffold off with storable bumpers, and folding the scaffold flat for storage and transportation.

20 Claims, 3 Drawing Sheets

FIG.1
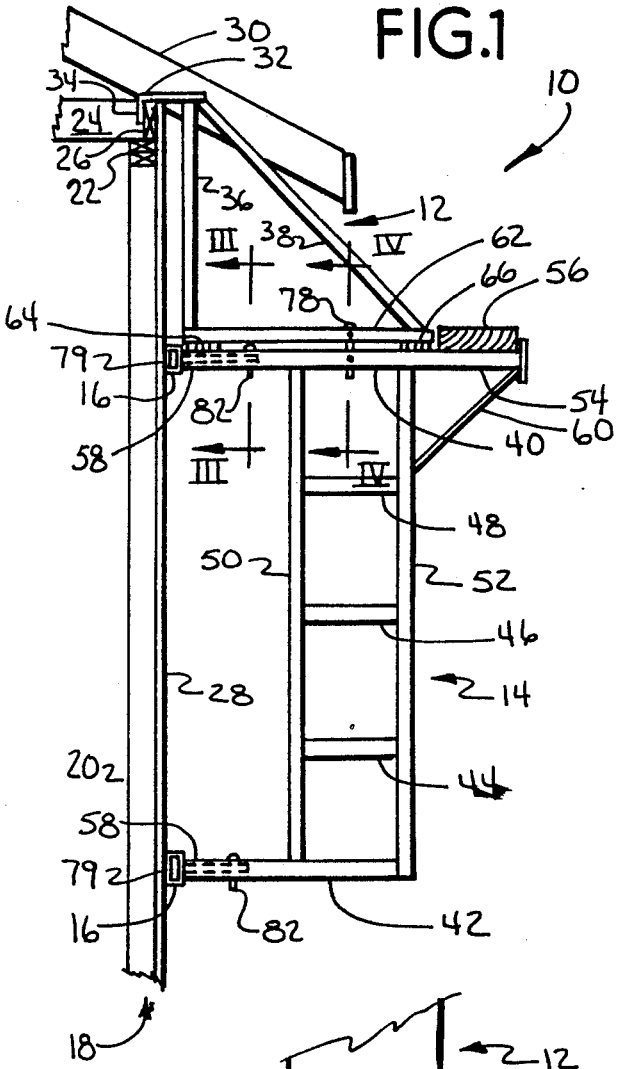
FIG.2
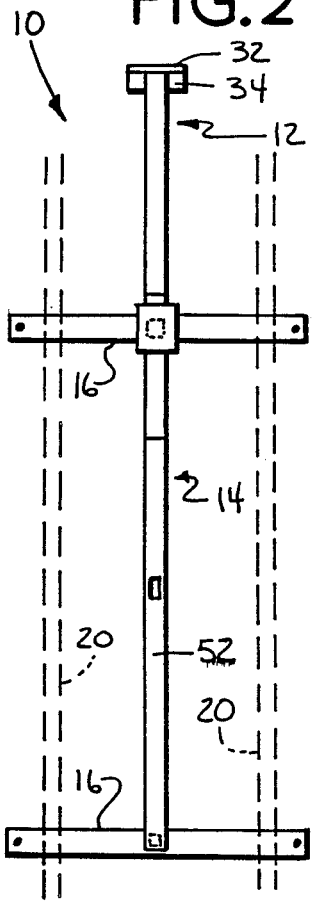
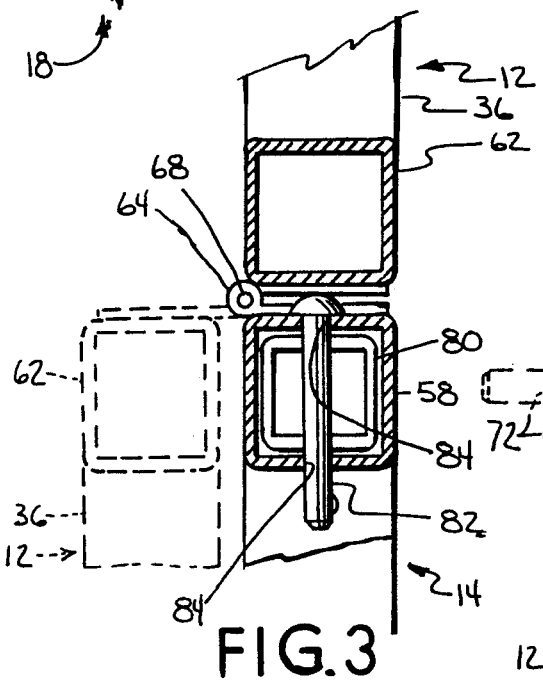
FIG.3
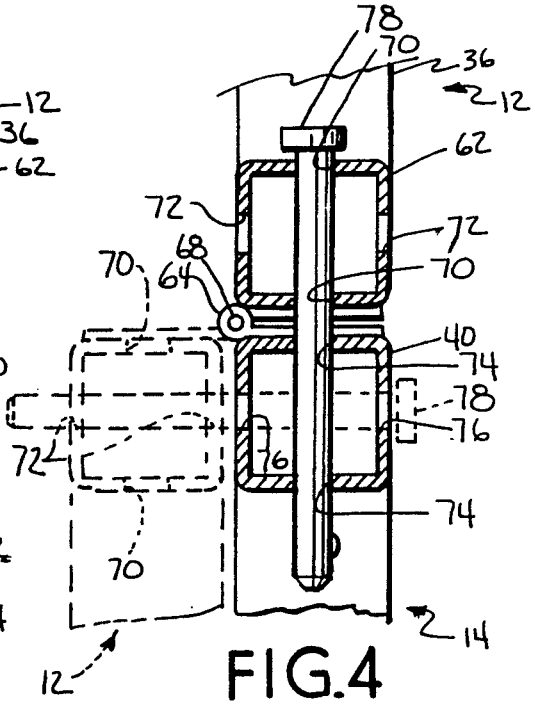
FIG.4

FIG.5
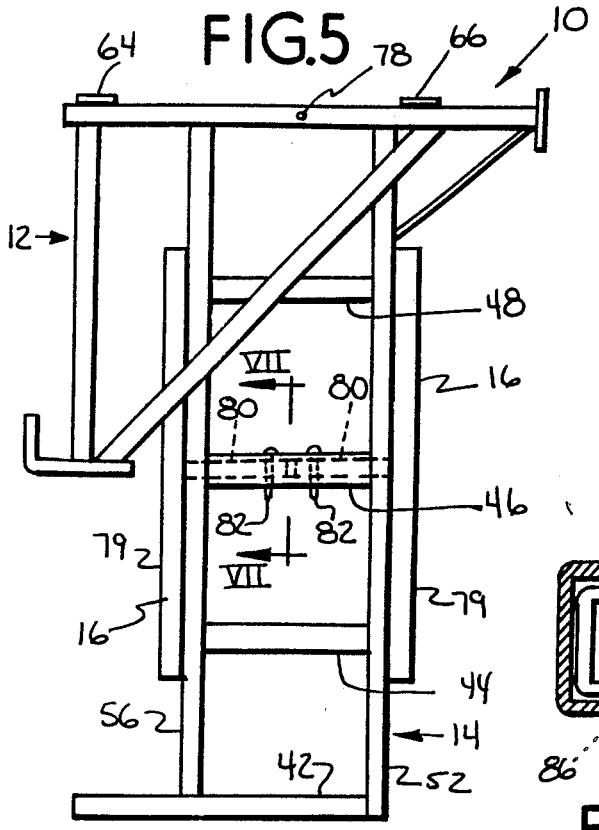
FIG.6
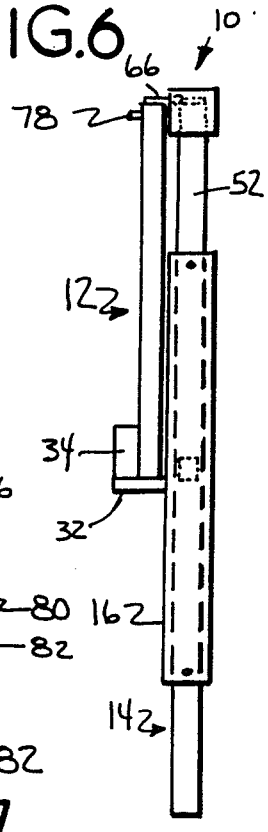
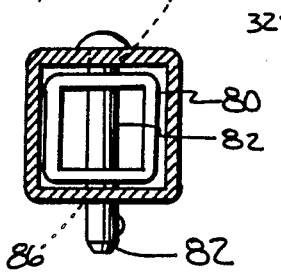
FIG.7
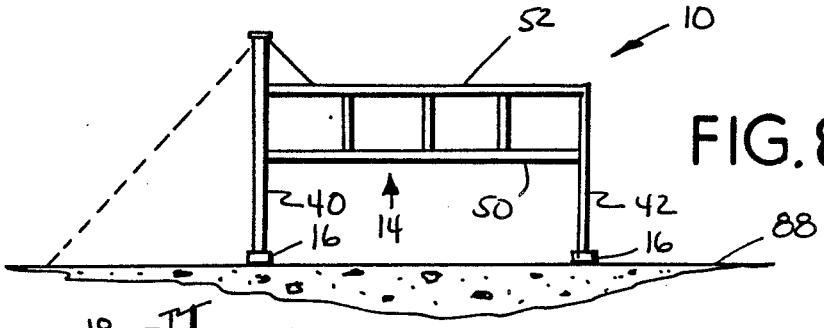
FIG.8
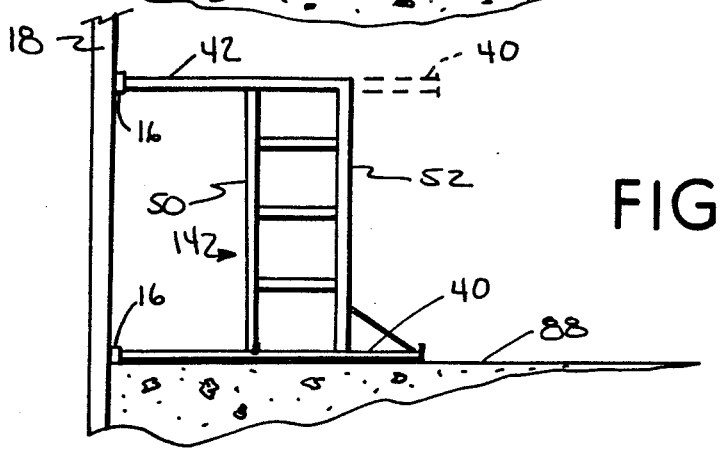
FIG.9

METHOD AND APPARATUS FOR SCAFFOLDING

BACKGROUND OF THE INVENTION

1. Field of the Invention

This invention pertains to a method and apparatus for scaffolding during the construction of a building, with a multiple purpose collapsible scaffold structure that is particularly well suited to hang from a wall header.

2. The Prior Art

Scaffolding is used extensively in construction, most often to go up. Existing scaffolding and the methods of its use involve clunky multi-piece apparatus that is difficult to transport, store, display, set-up, and is often of marginal safety.

No specific pertinant prior art such as a patent or commercial material is known, however extensive use of a great variety of scaffolding apparatus and methods are known to be deployed.

OBJECTS OF THE INVENTION

It is an object of this invention to provide a new and improved method of scaffolding.

It is an object of this invention to provide a new and improved folding scaffold and method of using the same.

It is an object of this invention to provide a new and improved scaffold for storing its bumpers, and a method of doing the same.

It is an object of this invention to provide a new and improved scaffold apparatus and a method for hanging the scaffold from the wall cap or joist of a building.

SUMMARY OF THE INVENTION

An improved scaffold has a work frame with a ladder, a hanger frame with hanging structure, folding structure between the frames, a bumper, and a bumper storing structure.

An improved scaffold has an upper hanging frame with a hook, a ladder hanging down from the frame, a lower bumper rung extending from the ladder, a bumper bar on the bumper rung, and structure for locking the bumper in either a normal use or a parallel storage position.

A method of using a scaffold has the steps of opening a hanger and work frame, affixing at least one bumper to the work frame, hanging the opened scaffold upon the top of a wall, pushing the work frame off with a bumper, lifting the scaffold up and off the wall, relocating the bumper and storing it parallel to the work frame, and folding the hanger frame over and alongside the work frame for storage or transportation of the scaffold.

BRIEF DESCRIPTION OF THE DRAWINGS

FIG. 1 is a side elevational view of the preferred embodiment of a scaffolding apparatus according to this invention, and which is useful in the practice of the methods of this invention;

FIG. 2 is an outer end elevational view of the apparatus of FIG. 1;

FIG. 3 is an elevational view in section through lines III—III of FIG. 1;

FIG. 4 is an elevational view in section through lines IV-13 IV of FIG. 1;

FIG. 5 is a side elevational view of the apparatus of FIG. 1, in an alternative collapsed configuration;

FIG. 6 is an outer end elevational view of FIG. 5;

FIG. 7 is an elevational view in section through lines VII—VII of FIG. 5;

FIG. 8 is a side elevational view of the apparatus of FIG. 1 in an alternative mode of use;

FIG. 9 is a side elevational view of the apparatus of FIG. 1 in a further alternative mode of use;

DESCRIPTION OF THE PREFERRED EMBODIMENT

Figure 10:
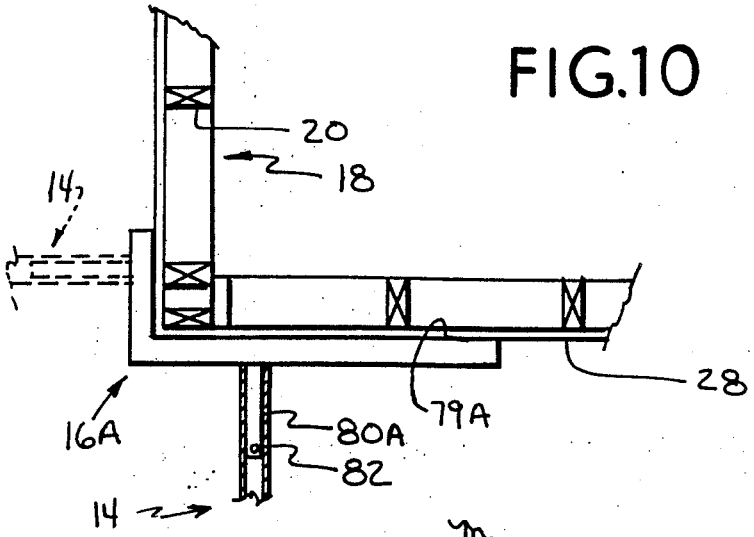
FIG. 10 is a top plan view of an accessory for the apparatus of FIG. 1, providing an additional mode of use.

In accordance with the principles of the present invention, a scaffording apparatus is provided as shown in FIG. 1 and is designated in general by the numeral 10, and will herein after be referred to as the scaffold 10 for purposes of brevity.

The scaffold 10 includes a hanging frame 12, a work frame 14 and at least one bumper member 16. The scafford 10 is particularily well suited for use upon the upright wall 18 of a building.

The typical wall, such as seen in residential and other frame buildings, has a plurality of upright studs 20, a wall cap 22, ceiling joists 24, a joist header 26 and outer sheathing 28. The wall 18 typically supports a roof structure 30 or an upper level (not shown). The scaffold 10 is specifically devised to vertically hang from the cap 22 on header 26 and to transversely abut against either the studs 20 or the sheathing 28.

The hanging frame 12 has a top hook 32 having an outward facing abutment 34 that goes over the top of and hooks against the backside or inside of either the cap 22 or header 26 to provide complete vertical support of the scaffold 10 and all work loads thereon. Extending downward from the hook 32 is a generally upright first hanger member 36 also in tension. In a simplified and least costly embodiment of the scaffold 10, the first and second hanger members 36, 38 are welded or otherwise rigidly fastened directly to the work frame 14.

The work frame 14 has an upper generally horizontal work rung 40, a lower bumper rung 42 and a plurality of ladder rungs 44, 46, 48 all of which are integrally held together and vertical supported and fixed by a pair of spaced apart inner and outer ladder uprights 50, 52. The work rung 40 has an outboard rung 54 that extends outwardly beyond the outer ladder upright 52 for support of one end of a horizontal walkway plank 56. In normal use there are at least a pair of the scaffolds 10 on each wall 18 with the scaffolds 10 being spaced from each other to support each end of the plank 56. The entire ladder componentry 44, 46, 48, 50, 52 is spaced outboard from inner cantilevered bumper ends 58 of the work and bumper rungs 40, 42. The outboard rung 54 is positioned to the outside of the outer ladder upright 52 and preferrably as a compresive diagonal brace 60 for strength, security and also useful for hanging tools and elongate work material.

The hanger frame 12 has a generally horizontal lower member 62 which is pivotally connected to the work frame 14 by at least one and preferrably two folding hinges 64, 66. The hinges 64, 66 are fastened to the lower member 62 and the upper work rung 40 inward of the outboard rung 54. Each hinge 64, 66 has its fulcrum pin 68 offset to one side enabling the hanger frame 12 to be rotated downward 180 degrees from the co-planar upright use position shown in FIGS. 1 & 2 and in solid lines in FIGS. 3 & 4, to an alternative collapsed storage and transportation position shown in dotted lines in FIGS. 3 & 4 and in FIGS. 5 & 6.

FIG. 4 illustrates that the hanger frame lower member 62 has criss-crossing upright axis use apertures 70 and horizontal axis storage aperatures 72 and that the work frame upper rung 40 likewise has a pair of upright axis use apertures 74 and a pair of horizontal axis storage apertures 76 with there being a frame lock pin 78 which will lock the hanger and work frames 12, 14 in either of the extended use positions shown in solid lines or the alternative folded storage position shown in dotted lines.

The bumpers 16 are generally T-shaped and have an abutment bar 79 secured to a normal leg 80 that fastens to the inboard rung ends 58. The leg 80 preferrably is a radially indexed slip fit inside of the rung ends 58 as best seen in FIG. 3. The legs 80 are then pinned and fixed into the rung ends 58 by bumper lock pins 82 through upright lock apertures 84. Note that the lock pins 78, 82 may be "real" lock pins with self-retaining detents as shown, or may be the commonly carried construction nails, i.e. 16*p* sinkers. The abutment bars 79 are each long enough to abut against at least two wall studs 20 and a preferred length of the bars 79 is about 32 inches, as is seen in FIG. 2.

When the scaffold 10 is collapsed to the configuration shown in FIGS. 5 & 6, the bumper lock pins 82 are pulled, and the bumpers 16 are pulled from the upper and lower rungs 40, 42 and the bumper legs 80 are slip fitted into an open end central ladder rung 46 after the bars 79 have been rotated from normal to parallel to the ladder uprights 50, 52 as best seen in FIGS. 5 & 6. The bumper legs 80 may also have crossing lock apertures enabling the lock pins 82 to be stored as shown, however if the legs 80 have a single set of lock apertures the lock pin 82 will be turned 90 degrees from what is shown in FIGS. 5 & 7. Regardless, the central ladder rung 46 has lock apertures 86 for retention of the bumpers 16 with the bars 79 being held parallel to the ladder uprights 50, 52 and locked by the pins 82.

The primary and focus use of the scaffold 10 is shown in FIGS. 1 & 2 wherein the scaffold 10 is hung on the wall 18 with all the weight being supported by the cap 22 or header 26. Alternatively the bumper bars 79 may also be fastened to will 18. FIG. 8 illustrates a further mode of use of the scaffold 10 on a generally horizontal base surface 88, which may be ground level or floor, as a sawhorse. The work material is placed atop the outer ladder upright 52, and work material may be stored on the inner ladder upright 50. FIG. 9 shows a further mode of use wherein the scaffold is turned work rung 40 down, placed on the base surface 88 and abutted against the wall 18. The work rung 40 may also be at the top as shown in dotted lines in which case it is desirable to fasten the top bumper 16 to the wall 18 for stability.

FIG. 10 illustrates an alternative and preferred optional bumper 16A with an asymetric L-shaped bumper bar 79A and the same bumper leg 80 for stable support of the work frame 14 adjacent a corner of the wall 18. If the alternative bumper 16A is flipped over, the work frame 14 would project outward at the dotted lines.

Figure 11:
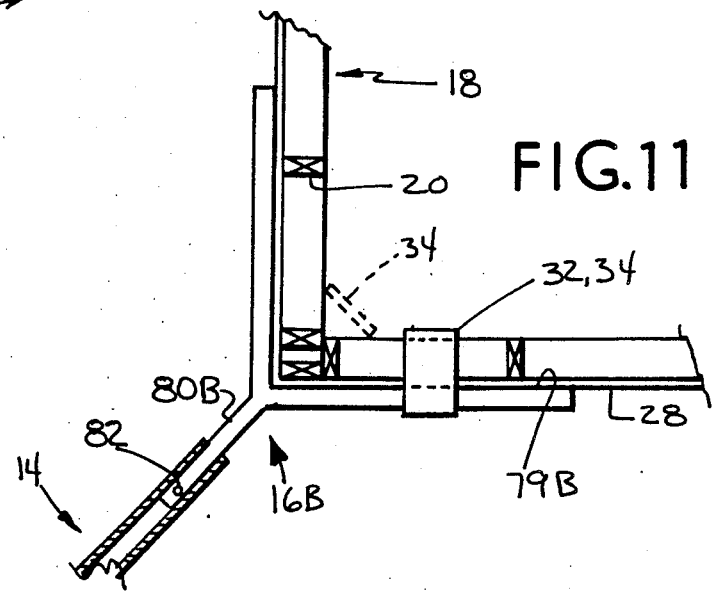
FIG. 11 is a top plan view of a further accessory for the apparatus of FIG. 1, providing a further additional mode of use.

FIG. 11 illustrates a second alternative and preferred optional bumper 16B having a generally Y shape formed by an equal length sided bumper bar 79B and an extended bumper leg 80B, which extends the work frame 14 outward on a diagonal from the wall 18. This particular mode of use will usually require the top hook and abutment(s) 32, 34 to be attached to the bumper bar 79B as is shown.

Figure 12:
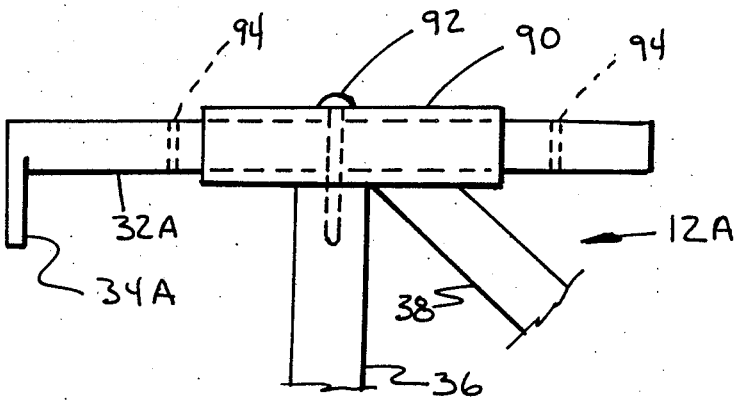
FIG. 12 is a side elevational view of an alternative adjustable hanger structure for the apparatus of FIG. 1.

FIG. 12 illustrates an optional and higher cost preferred alternative hanger hook 32A and abutment 34A that is slip fitted in a hanger tube 90 and held in any one of several places by a hook lock pin 92 slipped into one of several hook lock apertures 94. This alternative structure enables hanging from blocks, girders, logs and other unusual wall constructions.

The scaffold 10 will typically be supplied and used in a lowest cost version. A higher cost embodiment will be provided with a selection of all bumpers 16, 16A, 16B and the adjustable hook 32A, 34A structure. The scaffold 10 is capable of performing at least in he five modes shown herein plus many more permutational and yet unrealized functional modes. The scaffold 10 folds up easily and fits into and lies down in a pick up, a van, or a trailer. The scaffold 10 is ideal for contractors, hobby builders, rental business, maintenance departments and so forth. The scaffold is relatively easy to manufacture, is self-contained, and is extremely safe to use. All the lock pins 78, 82, 92 are in double shear for safety. The pins 78, 82, 92 may be tethered, or construction nails will suffice. The hanger and work frames positively lock in both positions.

Many other advantages, features and additional objects of the present invention will become manifest to those versed in the art upon making reference to the detailed description and accompanying drawings in which the preferred embodiment incorporating the principles of the present invention is set forth and shown by way of illustrative example.

Although other advantages may be found and realized and various modifications may be suggested by those versed in the art, be it understood that embody, within the scope of the patent warranted hereon, all such embodiments as reasonably and properly come within the scope of my contribution to the art.

I claim as my invention:

1. A scaffold comprising (a) a work frame having a ladder;

(b) a hanger frame having means for hanging the scaffold on a building wall;

(c) means for folding the hanger frame from a use configuration which is extended upward from said work frame, to a storage configuration parallel to and alongside the work frame;

(d) bumper means normal to said work frame for pushing the work frame off of the building wall; and (e) means for securing and storing said bumper means in a storage position parallel to said work frame.

2. The scaffold of claim 1, in which said folding means includes a hinge connecting said hanger and work frames to each other, said frames being capable of 180 degrees relative rotation about said hinge.

3. The scaffold of claim 2, in which said hinge connects a lower member of said hanger frame to an upper work rung of said work frame.

4. The scaffold of claim 2, in which said hinge has a fulcrum pin offset from a plane of said frames.

5. The scaffold of claim 2, in which said hinge is inboard of an outboard rung for supporting a walking plank.

6. The scaffold of claim 1, in which said bumper means has an L-shaped bumper bar, one leg of which extends away from said bumper securing and storing means, for pushing normally off of a building corner.

7. The scaffold of claim 1, in which said bumper means has a Y-shape, having legs extending away from said bumper securing and storing means, for pushing said work frame diagonally off of a building corner.

8. The scaffold of claim 1, in which said bumper means includes at least three bumper bars, said bars being respectively straight, L shaped, and Y-shaped.

9. The scaffold of claim 1, including a ladder in said work frame, a lower bumper rung extending from said ladder to said bumper means, and in which said securing and storing means includes an open ended ladder rung into which the bumper is securable.

10. The scaffold of claim 1, including frame locking means for locking said hanger and work frames in the use configuration.

11. The scaffold of claim 10, in which said frame locking means includes means for locking said hanger and work frames in the storage configuration.

12. The scaffold of claim 10, in which said frame locking means include apertures through the frames and straight lock pins insertable in said apertures.

13. A scaffold comprising (a) an upper generally trangular shaped hanger frame;

(b) a hanging hook on an upper acute apex of said hanger frame;

(c) a ladder hanging downward from a generally horizontal base member of said hanger frame, said ladder being spaced outward from an upright base member of said hanger frame;

(d) a lower bumper rung secured to said ladder and spaced below said hanger frame, said bumper rung having an inboard bumper end that is generally flush with said hanger frame upright base member;

(e) a bumper bar on the inboard end of said bumper end, (f) bumper locking means for locking said bumper to said bumper end in a position normal to a plane of said ladder; and (g) bumper storage locking means for alternatively locking said bumper to said ladder in storage position parallel to said ladder plane.

14. The scaffold of claim 13, including a bumper bar on an inboard end of an upper rung on said ladder and in which said bumper storage locking means includes means for storing and locking one of said bumper bars on each side of said ladder.

15. The scaffold of claim 14, in which said storage locking means comprise a central ladder rung open on both ends for reception of a bumper leg secured to each bumper bar.

16. A method of using a scaffold comprising the steps of (a) opening a hanger frame and a work frame from a side-by-side storage configuration to an in-line coplanar use configuration;

(b) affixing at least one bumper in a usage position that is normal to the work frame;

(c) hanging the opened scaffold upon the top of a wall and suspending the weight of the scaffold and any load thereon from the top of the wall;

(d) pushing the work frame off of the wall with the bumper;

(e) lifting and removing the scaffold up and off of the wall upon completion of construction;

(f) relocating the bumper and securing and storing it parallel to the work frame; and (g) folding the hanger frame over and alongside the work frame and into the storage configuration, so that said scaffold is flat for storage or transportation.

17. The method of claim 16, including the further steps of unlocking said hanger and work frames from the storage configuration before said stop of opening, and relocking said hanger work frames after the step of folding.

18. The method of claim 16, including the further steps of locking the hanger and work frames to each other in the use configuration after said step of opening, and unlocking said hanger and work frames from each other after said steps of lifting and removing.

19. The method of claim 16, including the further steps of locking the bumper to the work frame during said step of affixing, unlocking the bumper before said step of relocating, and then locking the bumper to the work frame after said step of relocating.

20. The method of claim 16, including the further step of providing an alterative geometry bumper to replace the original said bumper, and pushing the work frame off of a corner of said wall with said alternative geometry bumper.

* * * * *